US006883693B2

(12) United States Patent
Han

(10) Patent No.: US 6,883,693 B2
(45) Date of Patent: Apr. 26, 2005

(54) KNAPSACK WITH STEREOPHONIC REPRODUCING KIT

(76) Inventor: Angela W. Han, Fl. 7, No. 44, Lane 11, Kuang Fu North Road, Taipei (TW)

( * ) Notice: Subject to any disclaimer, the term of this patent is extended or adjusted under 35 U.S.C. 154(b) by 72 days.

(21) Appl. No.: 10/412,464

(22) Filed: Apr. 10, 2003

(65) Prior Publication Data

US 2004/0200871 A1 Oct. 14, 2004

(51) Int. Cl.[7] ..... A45C 15/00

(52) U.S. Cl. ..... 224/576; 224/245; 224/930; 381/385

(58) Field of Search ..... 224/245, 259, 224/576, 627, 637, 929, 930; 150/106; D3/216, 217; 381/300, 301, 385

(56) References Cited

U.S. PATENT DOCUMENTS 4,050,493 A * 9/1977 Cho ..... 150/106
4,589,134 A * 5/1986 Waldron ..... 381/301
5,001,779 A * 3/1991 Eggert et al. ..... 224/929
D351,943 S * 11/1994 Young ..... D3/216
5,409,152 A * 4/1995 Trevino ..... 224/576
5,897,042 A * 4/1999 Sims ..... 224/576
6,712,249 B2 * 3/2004 Magnusson et al. ..... 224/576
D489,174 S * 5/2004 Shigenaka et al. ..... D3/217
2002/0011931 A1 * 1/2002 Johnson et al. ..... 340/571
2002/0148871 A1 * 10/2002 Nakano et al. ..... 224/576

* cited by examiner

*Primary Examiner*—Gary E. Elkins
(74) *Attorney, Agent, or Firm*—W. Wayne Liauh

(57) ABSTRACT

A knapsack with stereophonic reproducing kit mainly includes a knapsack having pockets provided at predetermined positions for receiving a musical sound source and two speakers that together form basic items in the stereophonic reproducing kit. A user may enjoy listening to music or broadcast alone or with other companions at any time and at any place while carrying the knapsack on the back or on the shoulder.

6 Claims, 5 Drawing Sheets

KNAPSACK WITH STEREOPHONIC REPRODUCING KIT

FIELD OF THE INVENTION

The present invention relates to a knapsack with stereophonic reproducing kit that enables a user to carry a stereophonic reproducing kit with him and thereby enjoy listening to music or broadcast at any time and at any place.

BACKGROUND OF THE INVENTION

Music is a beautiful sound and almost all people enjoy listening to music. There are different types of music, including, for example, classical music, pop music, etc., and people usually have their own choice of favored music types. Most young students prefer to pop music and often enjoy listening to the music either indoors or outdoors. The development of portable stereophonic reproducing products, such as the so-called walkman, enable people to carry the stereophonic products with them and listen to the music with earphones without disturbing other surrounding people. It is really a wonderful feeling to freely enjoy music at any time and at any place.

However, to listen to music or broadcast using earphones for a prolonged time tends to endanger or be detrimental to the listener's eardrums and adversely affect the listener's normal hearing ability. Moreover, it is uncomfortable after the earphones have been plugged in the ear for an extended time period. Another disadvantage of the walkman is it is designed for one user to listen to the music alone, and it is impossible for a group of companions to enjoy the music at the same time via a walkman because the latter could not play the sound loudly.

SUMMARY OF THE INVENTION

It is therefore a primary object of the present invention to provide a knapsack with stereophonic reproducing kit, so that the stereophonic reproducing kit may be carried along with the user to loudly play good music for a group of companions at any time and at any place.

To achieve the above and other objects, the present invention mainly includes a knapsack provided with pockets for holding a musical sound source and two speakers. One the two speakers includes a power amplifier integrated circuit (IC), and the other speaker is loaded with batteries. The musical sound source and the two speakers are electrically connected to one another via wires, so that music reproduced from the sound source is amplified by and sent out via the speakers.

In the knapsack of the present invention, the pockets for holding the speakers are provided at left and right sides of the knapsack.

And, in the knapsack of the present invention, the pocket for holding the musical sound source is preferably provided at an inner upper side of a back-piece of the knapsack.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
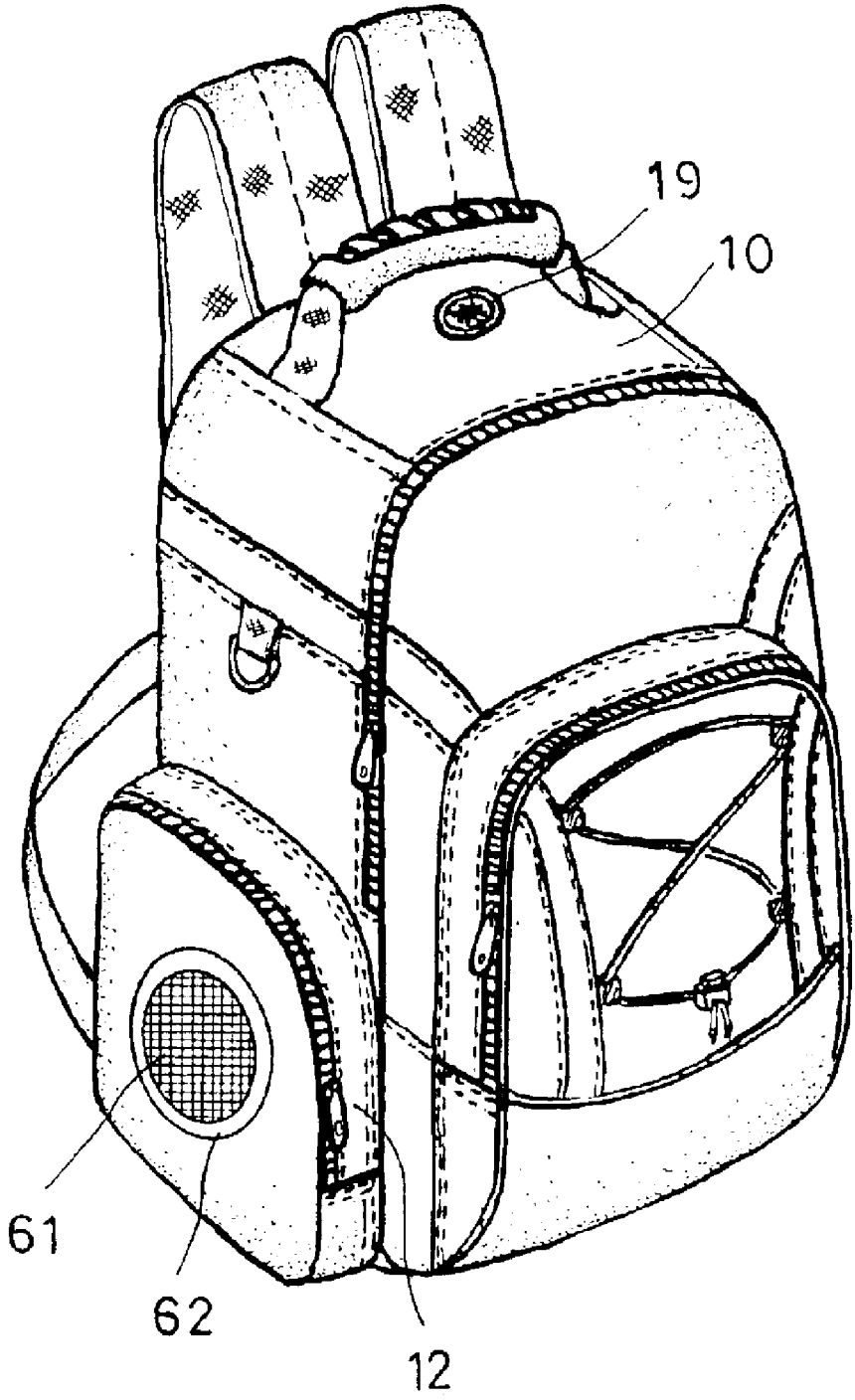
FIG. 1 is a perspective view of a knapsack with stereophonic reproducing kit according to an embodiment of the present invention.
Figure 2:
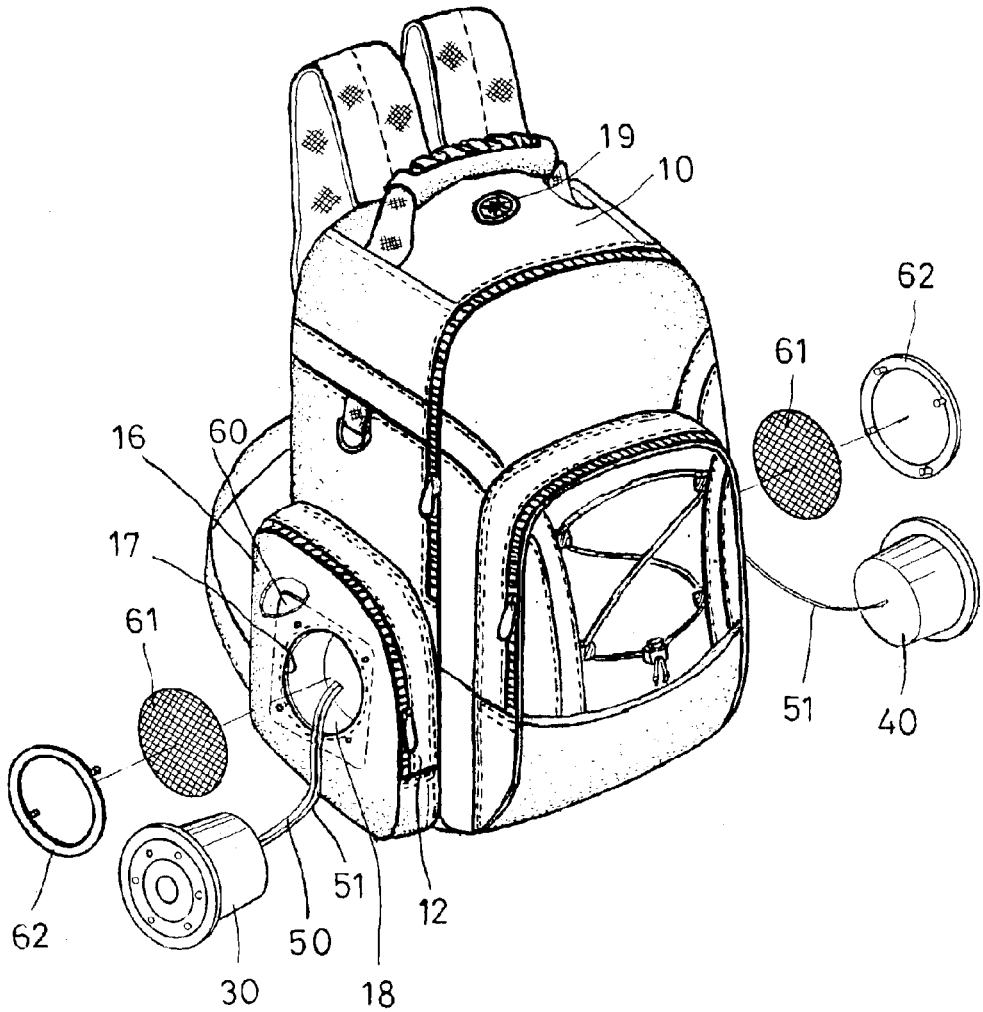
FIG. 2 is a partially exploded perspective view of the knapsack of FIG. 1.
Figure 3:
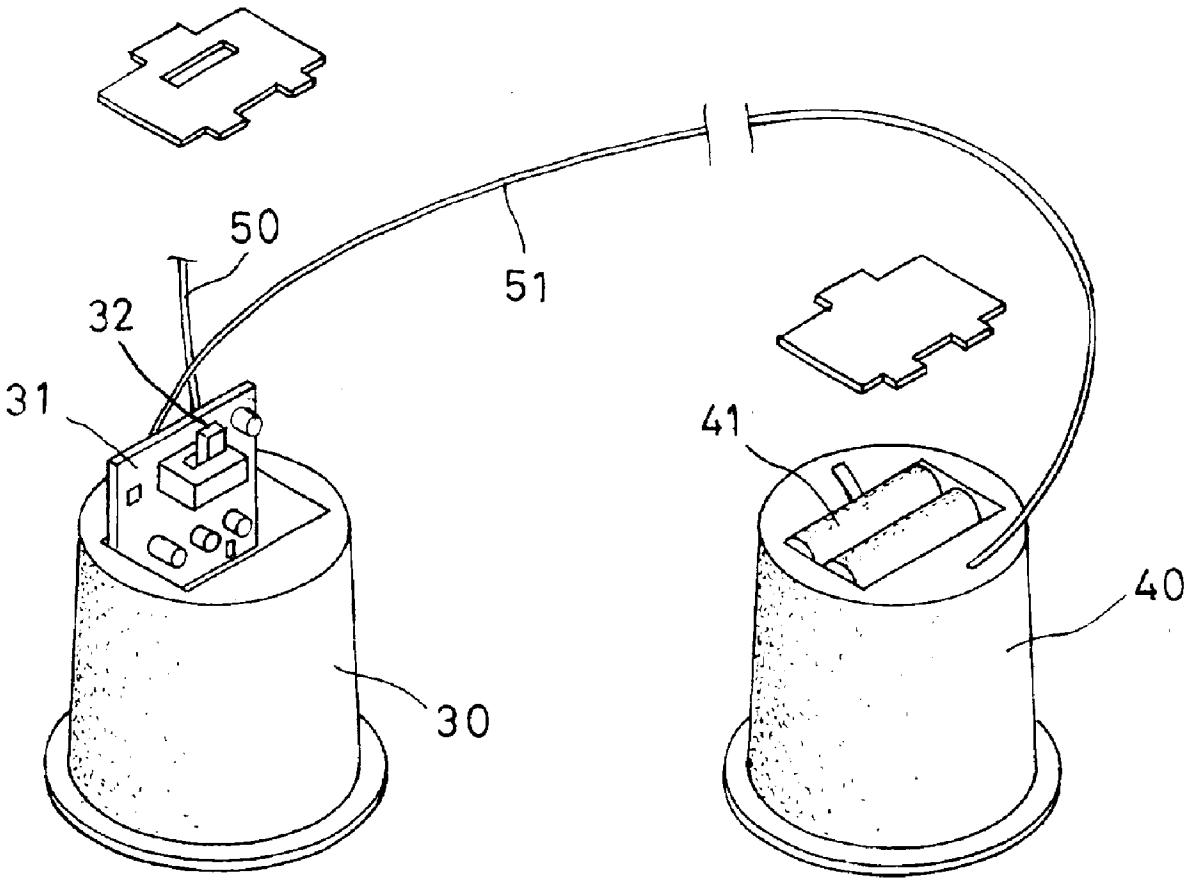
FIG. 3 is a bottom perspective view of two speakers included in the knapsack of the present invention, with two bottom covers of the speakers removed therefrom.

Please refer to FIGS. 1 and 2 that are assembled and partially exploded perspective views, respectively, of a knapsack with stereophonic reproducing kit according to an embodiment of the present invention. As shown, the present invention mainly includes a knapsack 10, and a musical sound source 20 (see FIG. 4) and first and second speakers 30 and 40 that together constitute main parts of a stereophonic reproducing kit in the present invention. The knapsack 10 is provided at left and right sides with two side pockets 12 and 13 for receiving the first and second speakers 30, 40 therein. As can be seen from FIG. 4, the knapsack 10 is provided at an upper inner side of a back-piece with an inner pocket 11 for receiving the musical sound source 20 therein. Please refer to FIG. 3. The first speaker 30 is internally provided with a power amplifier integrated circuit (IC) 31, and the second speaker 40 is internally provided with a predetermined number of batteries 41. The first speaker 30 is electrically connected to the musical sound source 20 via a first wire 50, and the two speakers 30, 40 are electrically connected to each other via a second wire 51, so that music reproduced from the musical sound source 20 may be amplified by the power amplifier IC 31 and sent out via the first and second speakers 30, 40.

In the illustrated embodiment, the present invention includes the knapsack 10 that is designed for carrying on a user's back. However, it is also possible for the present invention to include a shoulder bag (not shown) for carrying on the user's shoulder. The inner pocket 11 of the knapsack 10 is provided mainly to receive the musical sound source 20, which may be, for example, a walkman. The first wire 50 is extended between the musical sound source 20 and the first speaker 30, and the second wire 51 is extended between the two speakers 30 and 40. It is preferable the wires 50, 51 are closely attached to inner wall surfaces of the knapsack 10. Please refer to FIG. 4. The knapsack 10 is provided on its inner wall surfaces with pipes 14 and 15, through which the wires 50 and 51 are respectively extended to thereby be confined to fixed positions in the knapsack 10.

Figure 5:
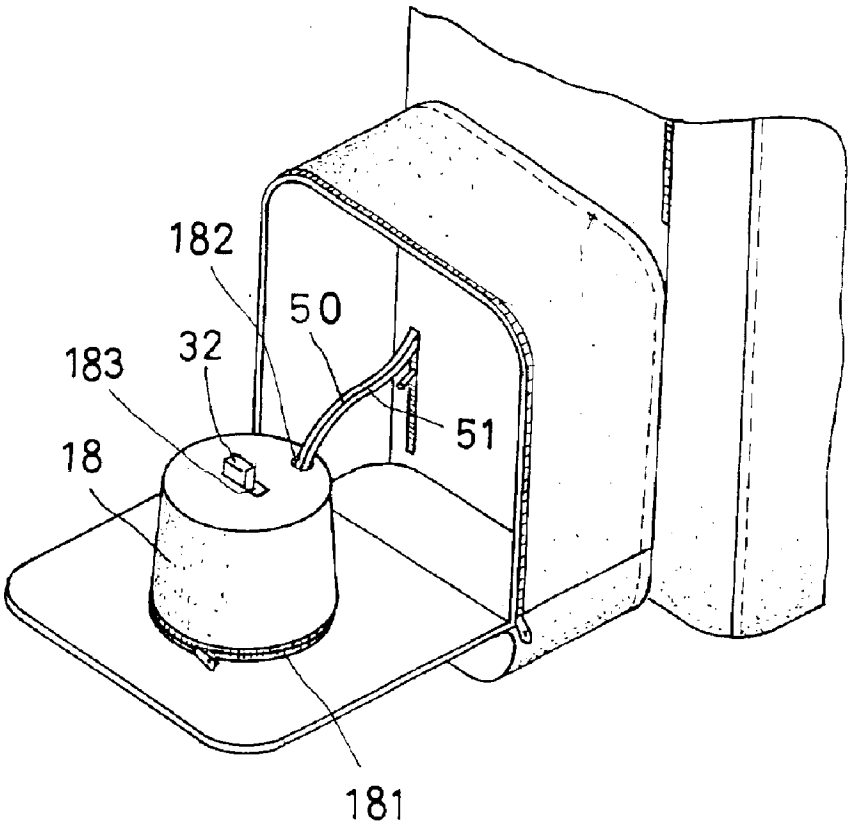
FIG. 5 is a fragmentary perspective view of the knapsack of the present invention showing an internal structure of a side pocket thereof.

Please refer to FIGS. 2 and 5 at the same time. Since the two side pockets 12, 13 are substantially symmetrically formed, only the side pocket 12 is described in details herein. As shown, the side pocket 12 includes a flap 16 having an opening 17 formed thereon. A pouch 18 adapted for fitly receiving the speaker 30 therein is aligned with and connected to an inner side of the opening 17. The flap 16 is locally lined with a plastic sheet 60 having a central hole, so that the central hole of the plastic sheet 60 is aligned with the opening 17. A screen 61 is further attached to an outer side of the opening 17 and fixedly connected to the plastic sheet 60 with a fixing ring 62, so as to protectively abut on an outer end of the speaker 30 to prevent the latter from undesirably moving out of the opening 17. That is, the screen 61 serves to shield the speaker 30, and the fixing ring 62 to prevent the speaker 30 from falling out of the side pocket 12. The pouch 18 is connected at an outer end to the inner side of the opening 17 along a circumference thereof via a zipper 181. The pouch 18 is provided at an inner end with a small wire hole 182, via which the wires 50, 51 are extended to electrically connect the first speaker 30 positioned in the pouch 18 to the musical sound source 20 and the second speaker 40, respectively, and a small switch hole 183, from which a power switch 32 of the power amplifier IC 31 is exposed. Please also refer to FIG. 3 at the same time. When it is desired to connect the wires 50, 51 or to replace new batteries 41, simply open the zipper 181 at the outer end of the pouch 18 to move out the speaker 30 or 40.

Figure 6:
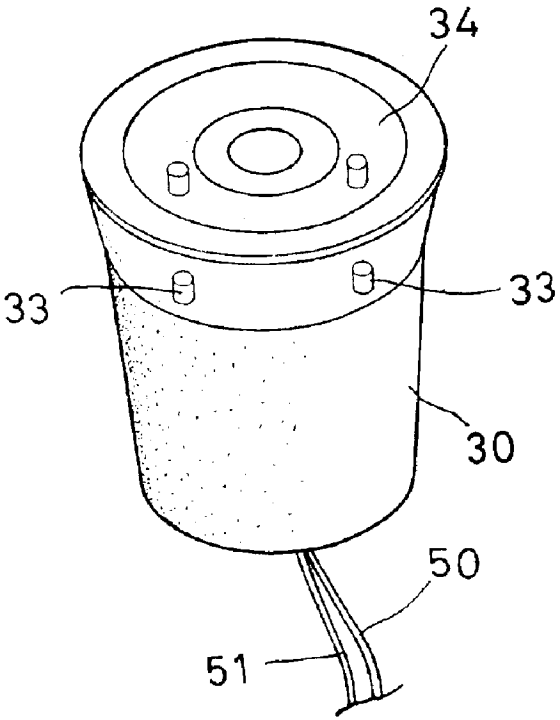
FIG. 6 is a top perspective view of a speaker included in the present invention.

It is preferable the knapsack 10 is made of a waterproof material, and the speakers 30, 40 have a watertight structure, so that the present invention may be used without being affected by weather factors. Please refer to FIG. 6. The speaker 30 may be provided at predetermined positions with a plurality of lamps 33 in the form of light-emitting diodes (LED). The LED lamps may also be provided on the speaker 40, though they are not shown in the illustrated drawings. The LED lamps 33 are so designed that they emit light when the stereophonic kit is in use, so that a combined sound and light effect is created. For this purpose, the speaker 30 has a transparent cover 34 connected to the outer end thereof to allow projection of light emitted from the LED lamps 33.

Once the first and second speakers 30 and 40 are positioned in the pouches 18 in the side pockets 12 and 13, it is not necessary to move them out, except when the batteries 41 are to be replaced. On the other hand, the musical sound source 20 may be changed from time to time as desired.

Figure 4:
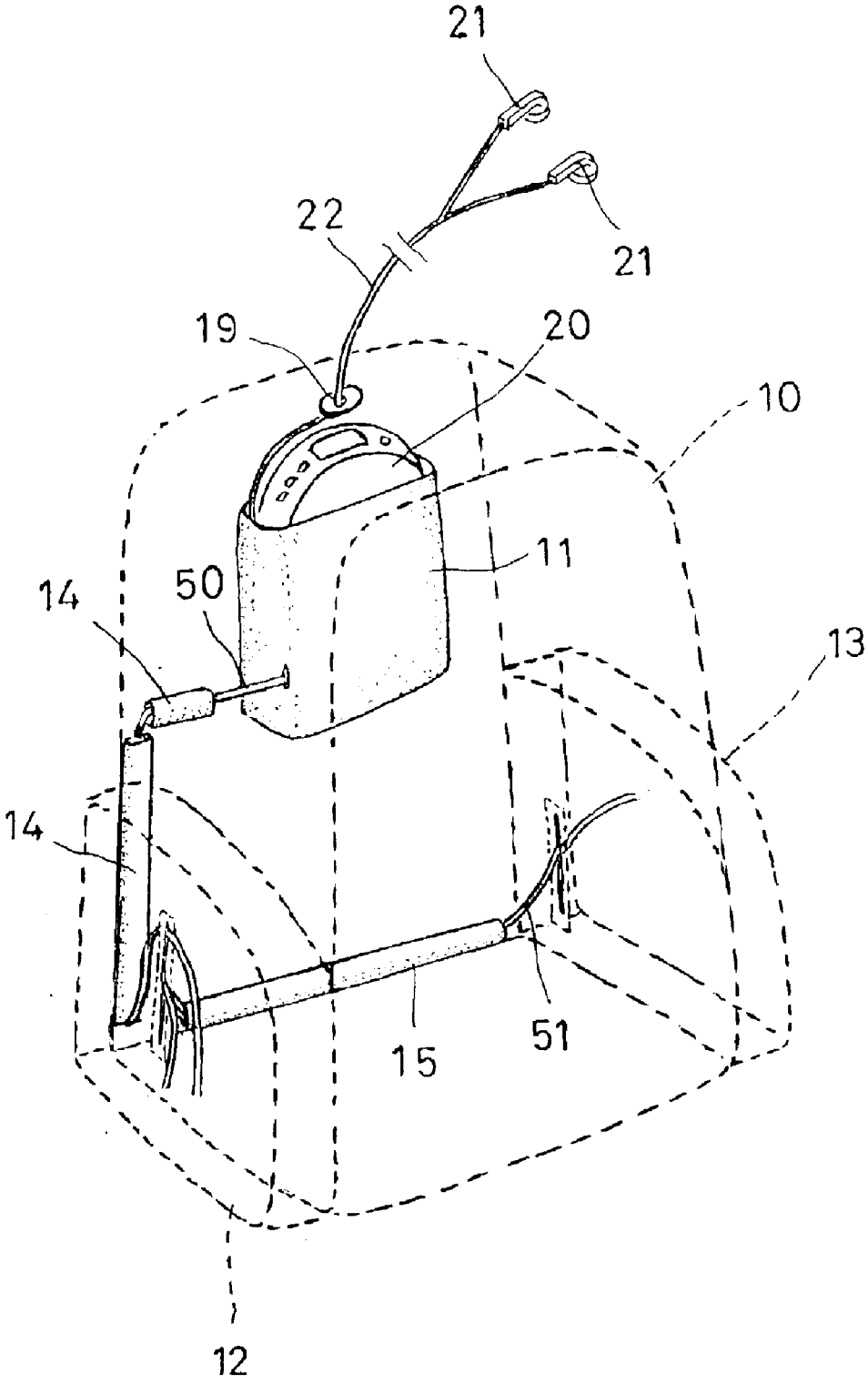
FIG. 4 shows the wiring inside the knapsack of the present invention.

When a group of persons desire to enjoy listening to a song or a piece of music together, the musical sound source 20 in the knapsack 10 and the power switch 32 of the power amplifier IC 31 at the rear end of the first speaker 30 may be turned on, allowing the song or music to be amplified and sent out via the speakers 30, 40 in the side pockets 12 and 13 of the knapsack 10 when the listeners are walking, or sitting or standing at somewhere. Alternatively, a user may use a pair of earphones 21 to listen to the music reproduced from the musical sound source 20 by plugging an earphone cord 22 onto the musical sound source 20 via a hole 19 provided on an upper end of the knapsack 10, as can be seen in FIG. 4. Of course, the user may also play the music via the speakers 30, 40 without using the earphones 21 if disturbing other people is not a concern.

In brief, the knapsack according to the present invention not only has the function of holding things, but also has particularly designed inner pocket and side pockets for holding different stereophonic reproducing and playing items, that is, the musical sound source 20 and the speakers 30 and 40, enabling a user to freely enjoy music at any time and at any place while carrying the knapsack 10 on the back or on the shoulder.

What is claimed is:

1. A knapsack with stereophonic reproducing kit, comprising a knapsack, and a musical sound source and first and second speakers that together constituting major parts of said stereophonic reproducing kit;

said knapsack being provided at a predetermined internal position with an inner pocket for receiving said musical sound source therein, and at left and right sides with external side pockets for receiving said first and said second speakers therein; and said first speaker being internally provided with a power amplifier integrated circuit (IC), and said second speaker being internally provided with a predetermined number of batteries; said first speaker being electrically connected to said musical sound source via a first wire, and to said second speaker via a second wire; such that musical sound reproduced from said musical sound source is amplified by the power amplifier IC and sent out via said first and second speakers.

2. The knapsack with stereophonic reproducing kit as claimed in claim 1, wherein said inner pocket is located at an upper inner side of a back-piece of said knapsack.

3. The knapsack with stereophonic reproducing kit as claimed in claim 1, wherein each of said side pockets includes a flap having an opening provided thereon, said opening on said flap being shielded with a screen, and a pouch being connected at an outer open end to an inner side of said opening on said flap for fitly receiving one said speaker therein; said flap being locally lined with a plastic sheet with a centered hole on said plastic sheet aligned with said opening on said flap; and a fixing ring being fixed to said plastic sheet to abut on an outer end of one said speaker to prevent said speaker from moving out of said pouch via said opening on said flap.

4. The knapsack with stereophonic reproducing kit as claimed in claim 3, wherein said pouch is connected at the outer end to the inner side of said opening on said flap via a zipper, and said pouch being provided at an inner end with a wire hole for said first and said second wire to extend therethrough, and a switch hole for a power switch of said power amplifier IC to expose therefrom.

5. The knapsack with stereophonic reproducing kit as claimed in claim 1, wherein said first and said second speaker are provided at predetermined positions with lamps.

6. The knapsack with stereophonic reproducing kit as claimed in claim 5, wherein said lamps are light-emitting diodes (LED).

* * * * *